US005586495A

United States Patent [19]

Ogawa et al.

[11] Patent Number: 5,586,495

[45] Date of Patent: Dec. 24, 1996

[54] TRANSFER PRESS

[75] Inventors: Kazuo Ogawa; Naoaki Ikeoka, both of Komatsu, Japan

[73] Assignee: Kabushiki Kaisha Komatsu Seisakusho, Tokyo, Japan

[21] Appl. No.: 997,196

[22] Filed: Dec. 28, 1992

[30] Foreign Application Priority Data

| | | | |
|---|---|---|---|
| Dec. 27, 1991 | [JP] | Japan | 3-358319 |
| Jul. 15, 1992 | [JP] | Japan | 4-187759 |

[51] Int. Cl.[6] ..... B30B 15/30; B30B 15/04

[52] U.S. Cl. ..... 100/207; 72/405.05; 72/455; 100/214; 100/282

[58] Field of Search ..... 100/193, 207, 100/208, 214, 282; 72/404, 405, 455

[56] References Cited

U.S. PATENT DOCUMENTS

| | | | |
|---|---|---|---|
| 1,327,815 | 1/1920 | Francis | 100/193 |
| 3,707,908 | 1/1973 | Merk et al. | 100/207 |
| 3,724,364 | 4/1973 | Münch et al. | 100/214 |
| 3,779,155 | 12/1973 | Ohno | 100/207 |
| 4,137,840 | 2/1979 | Kubota | 100/282 X |
| 4,461,206 | 7/1984 | Baba | 100/208 |
| 5,012,665 | 5/1991 | Brandstetter | 72/405 |

FOREIGN PATENT DOCUMENTS

| | | | |
|---|---|---|---|
| 0439684 | 8/1991 | European Pat. Off. | 100/282 |
| 2377855 | 8/1978 | France | 72/405 |
| 58-212900 | 12/1983 | Japan | 100/214 |
| 4414 | 1/1892 | Switzerland | 100/193 |
| 2227697 | 8/1990 | United Kingdom | 72/405 |

*Primary Examiner*—Stephen F. Gerrity
*Attorney, Agent, or Firm*—Richards, Medlock & Andrews

[57] ABSTRACT

A transfer press, capable of being easily transported, capable of being adjusted flexibly to changes in specifications, and capable of eliminating the idling of the transfer feeder, has a body (1) which is divided into a bed (2), uprights (3) provided vertically upon the bed, a pair of supporting beams (4) provided upon the uprights and disposed in spaced relationship with each other in a horizontal direction perpendicular to the direction in which a workpiece is fed, and a plurality of pressing units (5) each of which is independently provided for a respective one of a plurality of pressing operations. Each of the pressing units (5) comprises a crown (6) accommodating a slide-driving mechanism (8), and a slide (7). The crowns (6), provided for the individual pressing operations, are removably mounted upon the supporting beams (4). Slide guides (12) for guiding the vertical motion of the slides (7) are also provided on the supporting beams (4).

21 Claims, 6 Drawing Sheets

TRANSFER PRESS

FIELD OF THE INVENTION

The present invention relates to a transfer press for sequentially performing a plurality of pressing operations at a plurality of workstations. In a specific aspect, the invention relates to a transfer press in which a press unit, comprising a crown and a slide, is provided for each workstation so that an independent slide is provided at each workstation, and in which idle stations between workstations are made unnecessary.

DESCRIPTION OF RELATED ART

A transfer press is a power press which is particularly applicable to shaping metal and/or plastic workpieces in a plurality of steps or pressing operations. Hitherto, a transfer press equipped with a transfer feeder has been constructed such that a plurality of workstations are provided within the body of the press, and the pressing operations are performed while the workstations are sequentially fed with workpieces by the transfer feeder.

In recent years, as the size of transfer presses has increased, their construction has often been restricted in view of transportation constraints. Accordingly, various measures, such as providing an independent structure for each pressing operation, have been taken. Some of such conventional measures are described below.

In a conventional transfer press, shown in FIG. 1, a crown a and a slide b are provided independently for each of the pressing operations, and guide means c for guiding the slides b are mounted on uprights d arranged at a plurality of locations.

In another conventional transfer press, shown in FIGS. 2 and 3, crowns a, slides b, beds e, etc. are divided into relatively small parts, and these parts are assembled together by using keys and tie-bolts.

In a further conventional transfer press, shown in FIGS. 4 and 5, sub-slides f are provided for individual pressing operations. Also, a die-height adjustment apparatus, an overload safety apparatus, a load detecting apparatus and the like, are provided independently for each pressing operation.

However, with the construction of the transfer press shown in FIG. 1, the uprights d are located between workstations, thereby impairing operability as well as visibility. Since an idle station must be provided in correspondence with the location of each upright, the entire press becomes large, thereby increasing the setup man-hours. Another disadvantage is that the position of a workpiece can deviate at the idle stations, thereby lowering producibility.

With the construction of the transfer press shown in FIGS. 2 and 3, the dividing method has to be changed each time pressing specifications change. This is disadvantageous in that the man-hours for design and assembly are increased, and that systematization and standardization of various component parts are difficult.

With the construction of the transfer press shown in FIGS. 4 and 5, the space for providing the sub-slides f is inevitably limited by the arrangement of pressurizing points and assembly tie-bolts. Hence, the press has to be designed and produced with much difficulty. Further, the addition of the sub-slides f makes the entire construction complicated, and increases the weight of movable portions, thereby increasing power consumption. Since a guide means for a sub-slide f is provided within a slide, it is difficult for the sub-slides f to have a high level of precision. Further, since the height of the entire press increases, it can be difficult to install the press in an existing building.

In a conventional transfer press in which a slide is provided independently for each pressing process step, a guide means for guiding the vertical motion of a slide must be mounted on an upright. For this reason, it is necessary to provide uprights in the intervals between workstations. As a result, the pitch of the workstations becomes large, thereby increasing the feed stroke of the transfer feeder. This is disadvantageous in that the production speed lowers, and the transfer feeder becomes expensive.

In the above construction, if the production speed is to be increased and the production costs of the transfer feeder are to be lowered, it is necessary to provide idle stations between workstations. As a result, the total number of stations increases, thereby increasing the entire length of the press. This is disadvantageous in that setup man-hours increase. In addition, a workpiece, temporarily placed at an idle station, can have its position deviated, thereby involving the risk of feeding errors and the risk of producibility reduction.

SUMMARY OF THE INVENTION

The present invention has been accomplished to overcome the above-described disadvantages. An object of the present invention is to provide a transfer press that is capable of being easily transported, capable of being readily adjusted to changes in the press specifications, and capable of eliminating idling in such a manner as not to involve reduction in producibility and increase in transfer-feeder costs.

According to the present invention, a transfer press includes a body which comprises a bed, uprights provided vertically upon the bed, a pair of supporting beams provided upon the uprights and disposed in spaced relationship with each other in a horizontal direction perpendicular to the direction in which a workpiece is fed, and a plurality of pressing units each of which is independently provided for a respective one of a plurality of pressing operation steps, with these components of the body being readily disassembled or assembled. Each of the pressing units comprises a crown, accommodating a slide-driving mechanism, and a slide. The crowns, which are provided for the individual pressing operation steps, are removably mounted upon the supporting beams. Slide guides for guiding the vertical motion of the slides are also provided on the supporting beams.

With the above-specified construction of the invention, the transfer press can be easily transported after the bed, the uprights, the supporting beams, and the pressing units have been disassembled. When specifications are to be changed, the body of the press is ready to be assembled as soon as the type of pressing units fitting the changes has been selected. Thus, the design and production man-hours incurred by specification changes can be greatly reduced.

Furthermore, idle stations need not be provided between workstations. Thus, a construction that does not require idling is made possible while an increase in the feed stroke of the associated transfer feeder is simultaneously prevented, thereby providing increased producibility and low transfer-feeder costs.

DESCRIPTION OF THE PREFERRED EMBODIMENTS

A first embodiment of the present invention is described in detail with reference to the drawings provided in FIG. 6 through FIG. 12.

Figure 1:
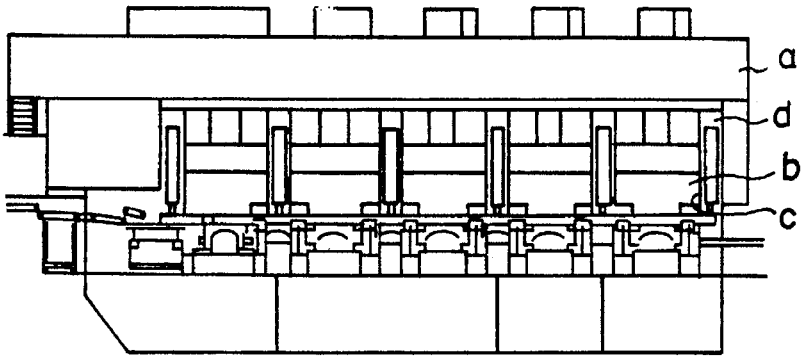
FIG. 1 (PRIOR ART)
FIG. 1 is a front view of a conventional transfer press.
Figure 2:
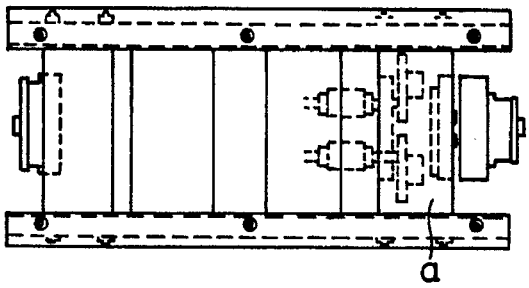
FIG. 2 (PRIOR ART)
FIG. 2 is a plan view of another conventional transfer press.
Figure 3:
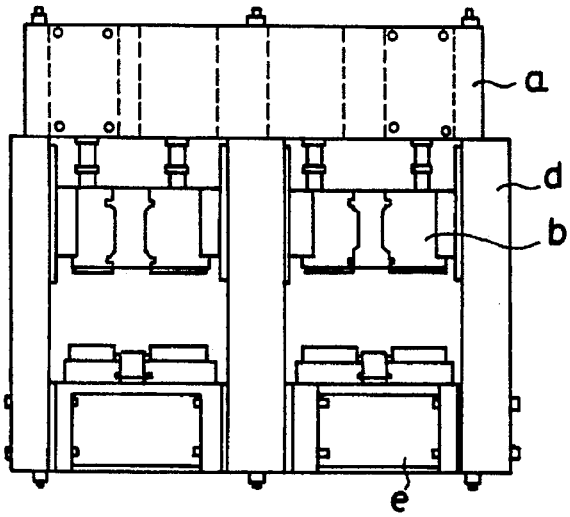
FIG. 3 (PRIOR ART)
FIG. 3 is a front view of the conventional transfer press shown in FIG. 2.
Figure 4:
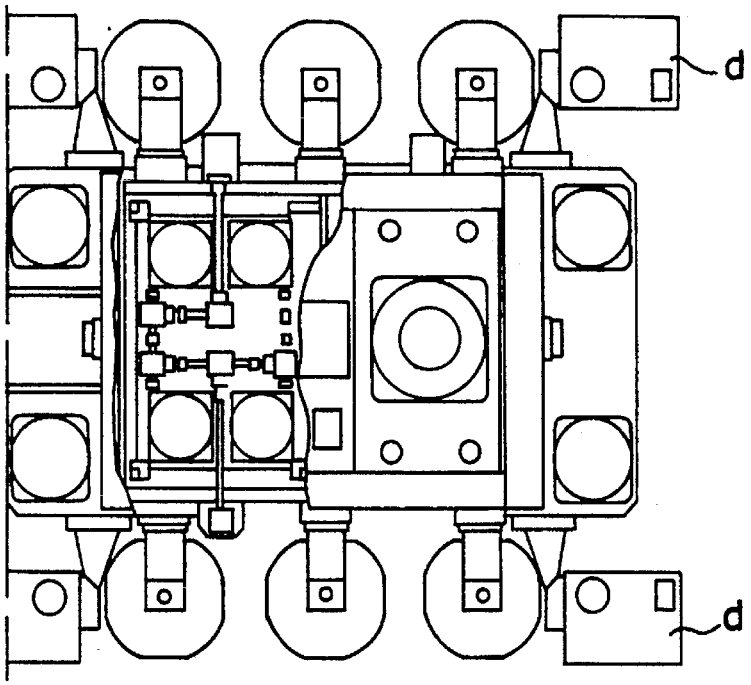
FIG. 4 (PRIOR ART)
FIG. 4 is a plan view of a further conventional transfer press.
Figure 5:
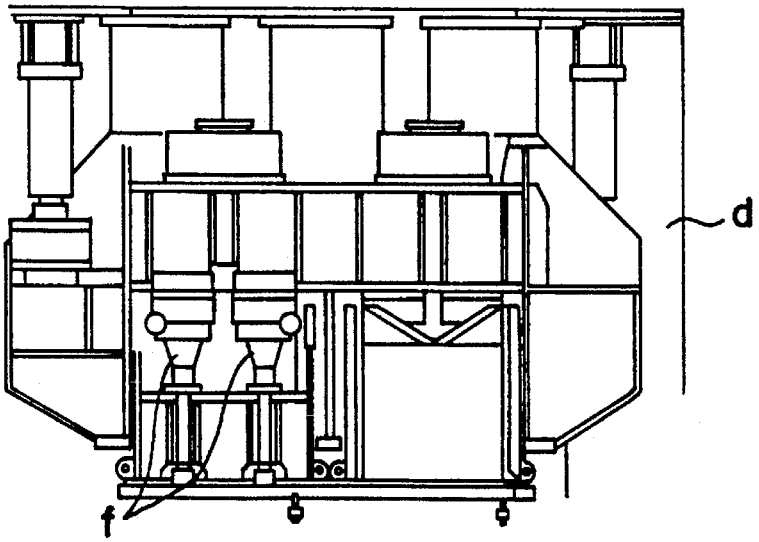
FIG. 5 (PRIOR ART)
FIG. 5 is a front view of the conventional transfer press shown in FIG. 4.

Referring to these drawings, a transfer press has a body 1 including a bed 2, uprights 3 provided vertically upon the bed 2, a pair of supporting beams 4 provided upon the uprights 3 and disposed on the front side (the side shown in FIG. 1) and the back side of the body 1 in spaced relationship with each other in a horizontal direction perpendicular to the direction in which a workpiece is fed, and a plurality of pressing units 5 each of which is independently provided for a respective one of a plurality of pressing operations. Each of the supporting beams 4 comprises an elongated, box-shaped supporting beam which extends in the work-feeding direction over at least substantially the full length of the body 1, and which forms either an integral structure or a structure divided into a plurality of beam parts.

The bed 2, the uprights 3, the pair of supporting beams 4 and the plurality of pressing units 5 are prepared as structures into which the body 1 can be readily divided upon disassembly of the transfer press, and are able to be transported individually. Therefore, the transfer press is free from restrictions of transportation, such as size and weight, and is able to be easily assembled at an installation site.

Upon assembling a transfer press having a plurality of workstations through which workpieces are sequentially fed in a first workpiece feed direction from workstation to workstation for accomplishing a plurality of pressing operations, the uprights 3 position the pair of supporting beams 4 so that the pair of supporting beams 4 extend at least generally parallel to the first direction with the pair of beams 4 being spaced apart from each other in a horizontal direction which is perpendicular to the first direction.

Figure 9:
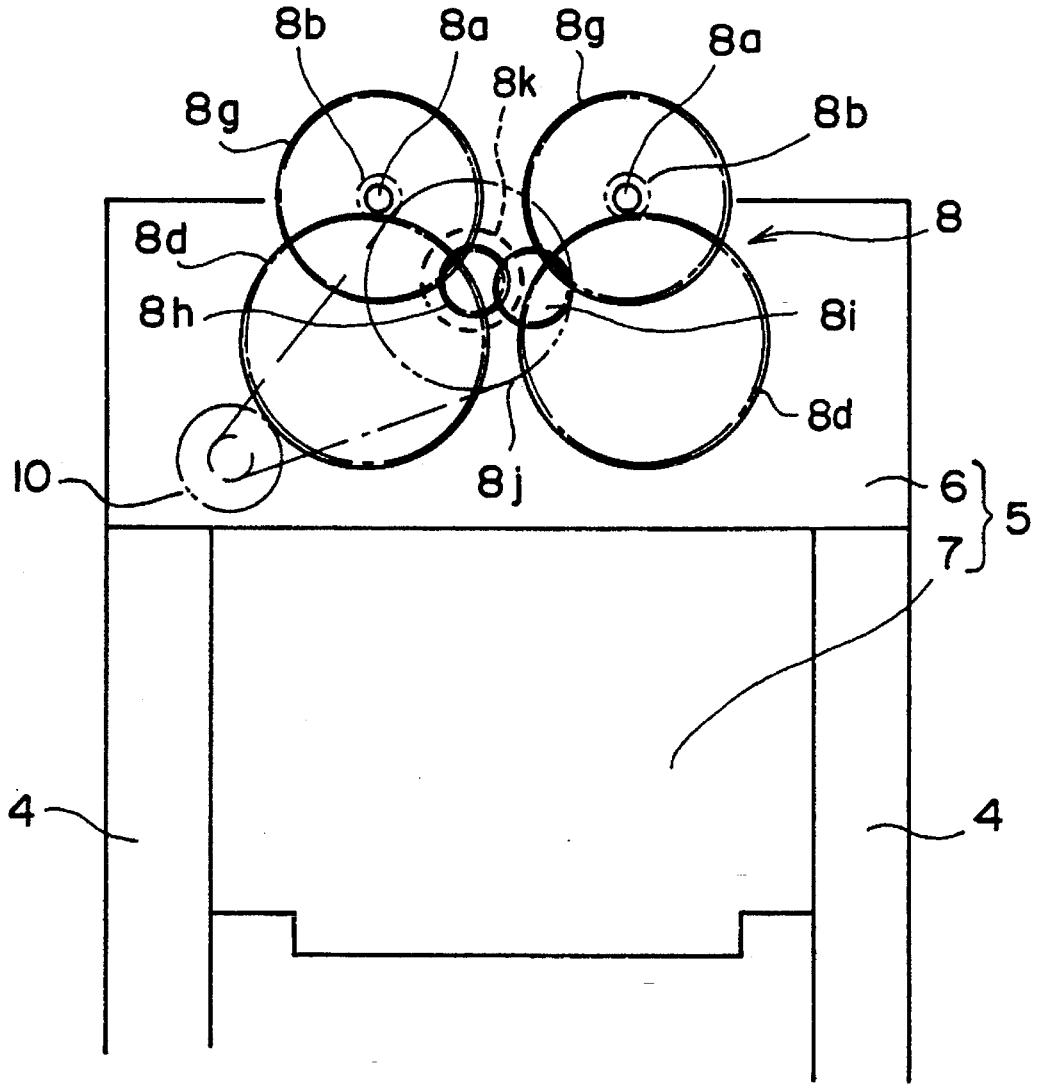
FIG. 9 is a view showing details of a slide-driving mechanism of a pressing unit at an upstream location of the transfer press according to the present invention.

Each of the pressing units 5 comprises a crown 6 and a slide 7. Each crown 6 accommodates a slide-driving mechanism 8. As shown in FIG. 9, each slide-driving mechanism 8 has a pair of drive shafts 8*a* provided at an upper portion of the corresponding crown 6, the drive shafts 8*a* extending in a direction parallel with the direction in which the supporting beams 4 extend. A plurality of pairs of drive shafts 8*a* are provided in correspondence with the number of the plurality of pressing units 5. During assembly, the front drive shafts 8*a* are assembled into a drive-shaft assembly by joining together the front drive shafts 8*a* of adjacent pressing units 5 by couplings (not shown), while the back drive shafts 8*a* are similarly assembled into a drive-shaft assembly by using couplings to join together the back drive shafts 8*a* of adjacent pressing units 5.

Figure 10:
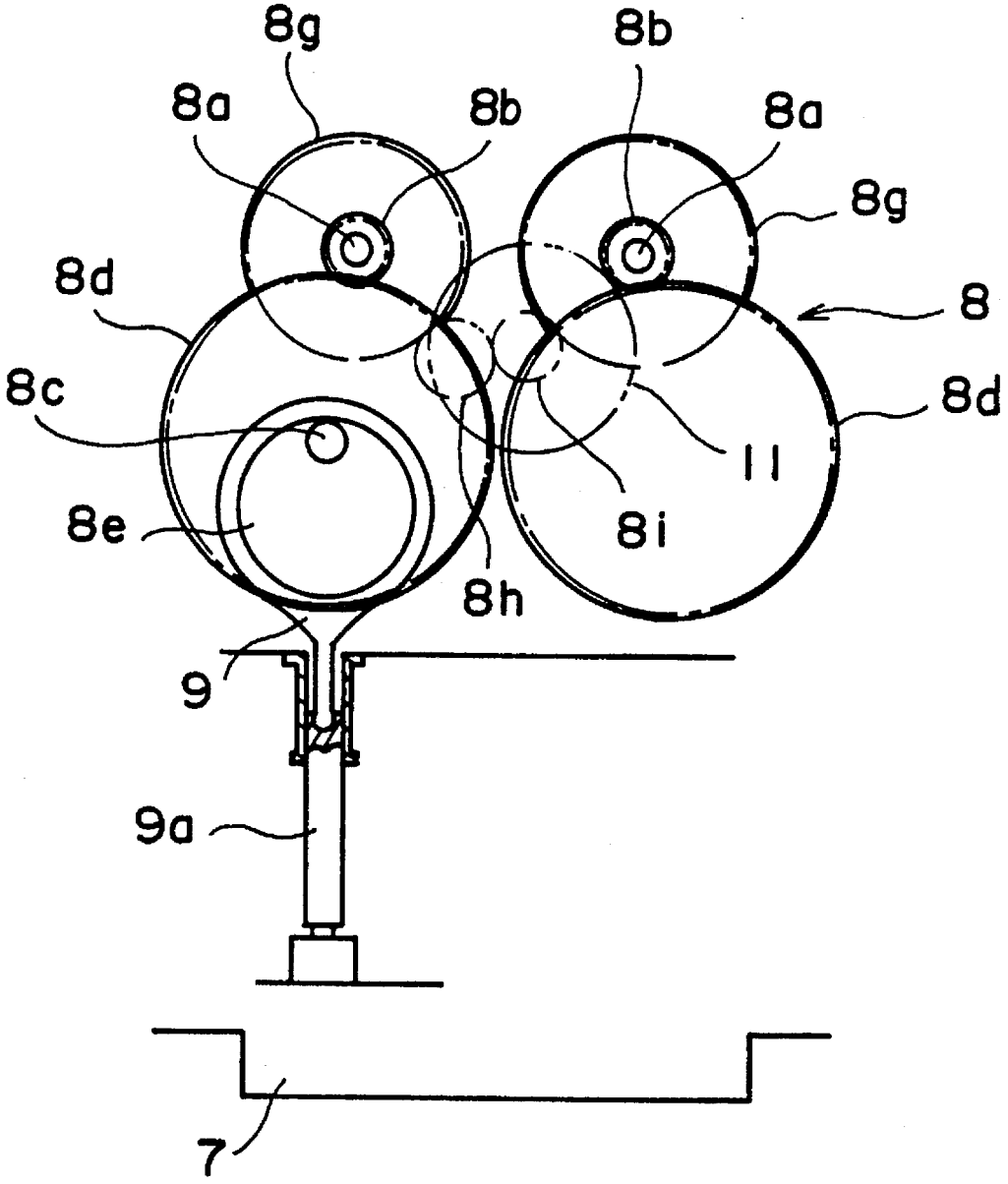
FIG. 10 is a view showing details of a slide-driving mechanism of a pressing unit at a downstream location of the transfer press according to the present invention.

A respective main pinion 8*b* is mounted on each drive shaft 8*a* for rotation therewith. As shown in FIG. 10, a respective main gear 8*d* is mounted on each eccentric shaft 8*c* for rotation therewith and is meshed with the respective main pinion 8*b*. The eccentric shaft 8*c* has an eccentric portion 8*e* supporting one end of a connecting rod 9 (only one of the connecting rods of the mechanism 8 is shown in FIG. 10). The other end of the connecting rod 9 is connected to the associated slide 7 through a plunger 9*a*.

During the assembly of the body 1, a respective drive gear 8*g* is mounted on each of the pair of drive shafts 8*a* of one of the pressing units 5, e.g., the pressing unit 5 located in correspondence with the most upstream pressing operation workstation, and the drive gears 8*g* are meshed with a drive pinion 8*h* and an idle gear 8*i*. The drive pinion 8*h* is operationally connected with and driven by a flywheel 8*j* having a built-in clutch 8*k*. The drive pinion 8*h* drives the drive gear 8*g* on one of the pair of drive shafts 8*a* by direct engagement therewith and drives the drive gear 8*g* on the other drive shaft 8*a* via the idle gear 8*i*. Thus, when the flywheel 8*j* is rotatively driven by a main motor 10, shown in FIG. 9, the plurality of slide-driving mechanisms 8 are simultaneously driven. In one of the pressing units 5, e.g., the pressing unit 5 located in correspondence with the most downstream workstation, a brake 11 is mounted, as shown in FIG. 10.

Figure 8:
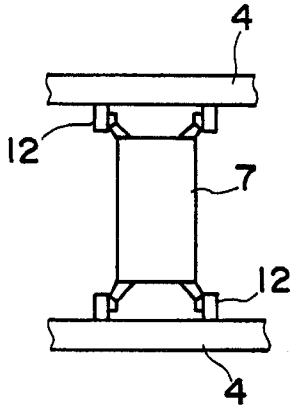
FIG. 8 is a plan view of a slide guide portion of the transfer press according to the present invention.

As shown in FIG. 8, a plurality of slide guides 12 are provided in correspondence with the number of pressing operations (workstations), with the slide guides 12 being mounted only on the inner sides of the pair of supporting beams 4 disposed on the front and back sides of the body 1, the slide guides 12 being positioned to guide the vertical movement of the respective associated slide. This structure avoids the necessity of having uprights between each adjacent pair of workstations in order to guide the slides for those workstations.

Figure 6:
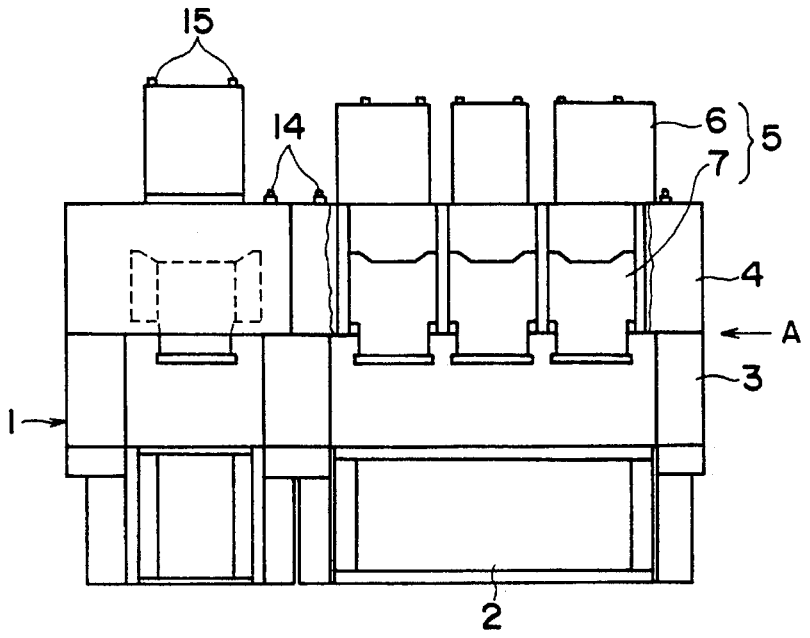
FIG. 6 is a front view of a transfer press according to a first embodiment of the present invention.
Figure 7:
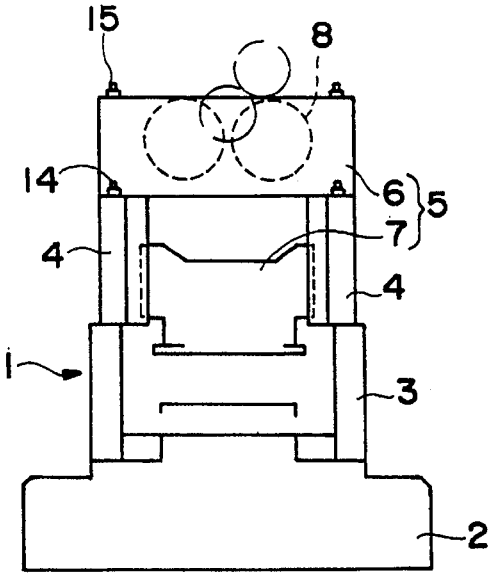
FIG. 7 is an end view taken from arrow A shown in FIG. 6.

As shown in FIGS. 6 and 7, the supporting beams 4 are fastened to the bed 2 through the uprights 3 by tie-bolts 14. Further, the crowns 6 of the pressing units 5 are fastened to the supporting beams 4 by other tie-bolts 15.

The assembly of the transfer press is explained below. As described above, the bed 1, the uprights 3, the supporting beams 4 and the pressing units 5 of the body 1 of the transfer press are formed as structures independent from each other, and the pair of supporting beams 4 to be disposed at positions on either side of the body 1 comprise box-shaped structures preferably extending over the full length of the body 1. When these components of the body 1, that is, the bed 2, the uprights 3, the supporting beams 4 and the pressing units 5, have been transported in their disassembled state to an assembly site, the bed 2 is installed first. Then, the uprights 3 are placed upon the bed 2, and the pair of supporting beams 4 are placed upon the uprights 3. The uprights 3 are positioned on the bed 2 as a first set thereof supporting the front-side supporting beam 4 and a second set thereof supporting the back-side supporting beam 4, with the number of uprights in each of the first and second sets being less than the number of pressing units. In a three-column press, each supporting beam 4 would be supported by three uprights, one located at one end portion of the supporting beam, one located at the other end portion of the supporting beam, and one located at an intermediate position, as the only substantial support for the supporting beam 4. Thereafter, the bed 2, the uprights 3 and the supporting beams 4 are fastened together by the tie-bolts 14, as shown in FIGS. 7 and 6. Subsequently, each pressing unit 5 is suspended from above by being placed in a respective space between the front-side supporting beam 4 and the back-side supporting beam 4, and then the crowns 6 of the pressing units 5 and the supporting beams 4 are fastened together by the tie-bolts 15. In this stage of assembly, the clearance between various members can be adjusted so that the vertical motion of the slides 7 can be properly guided by the corresponding slide guides 12 provided at a plurality of locations of the front-side and back-side supporting beams 4.

The drive shafts 8*a* of the pressing units 5 are joined together by couplings, and thus assembled into a pair of drive-shaft assemblies. Thereafter, the drive shafts 8*a* of one of the pressing units 5, e.g., the pressing unit located for the workstation furtherest upstream, can be connected with the main motor 10 and the associated drive components. Further, the drive shafts 8*a* of one of the pressing units 5, e.g. the pressing unit located at the furtherest downstream workstation, are connected with the brake 11. Alternatively, the brake 11 can be provided in an upstream pressing unit 5 and the motor drive can be provided in a downstream pressing unit 5.

Figure 11:
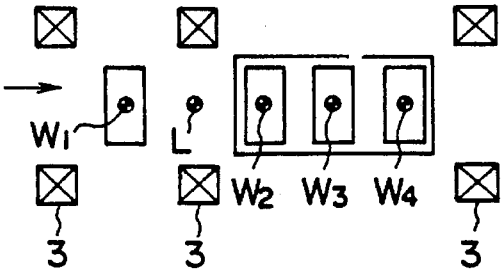
FIG. 11 is a view showing a layout of a transfer press according to the present invention.

FIG. 11 shows an example of a layout of a three-column transfer press, in which a press unit 5 is located at a workstation $W_1$ and other pressing units 5 are located at other workstations $W_2$, $W_3$ and $W_4$, with an idle station L being provided behind an upright 3 at an intermediate location (that is, provided between the workstations $W_1$ and $W_2$).

Figure 12:
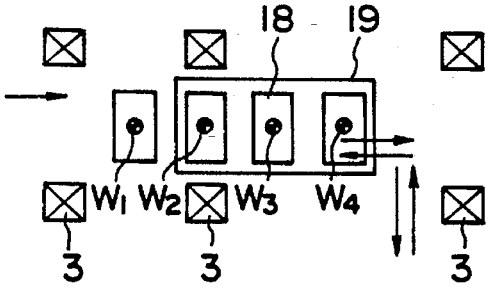
FIG. 12 is a view showing another layout of a transfer press according to the present invention.

Alternatively, as shown in FIG. 12, a pressing unit 5 can be provided behind the upright 3 at the intermediate location, thereby omitting an idle station L. When a pressing die 18 is to be replaced, a moving bolster 19 can be moved to a downstream location, and then moved through the interval between uprights 3 on the front side of the press.

With the above-described first embodiment, even though each of a plurality of pressing units 5 independently corresponds to a respective one of a plurality of pressing operations, the number of uprights 3 need not be increased, thereby improving operability and visibility. In addition, the design and production man-hours incurred by specification changes can be greatly reduced.

Further, the pressing load can be checked with respect to each of pressing operations, thereby reducing the risk of overload causing damages to the pressing units 5 or to the pressing dies, and the risk of deformation caused by a pressing operation influencing other pressing operations. This makes it possible to increase forming precision. Even when a failure has occurred in one of the pressing units 5, the particular pressing unit can be readily replaced with a new one, and the operation can be continued. This makes it possible to prevent a significant reduction in the rate of operation. When the particular pressing unit 5 has been dismounted from the supporting beams 4, the pressing unit can be repaired on the floor, thereby avoiding dangerous, high-spot work. If the components of pressing units 5 and supporting beams 4 are systematized and standardized, specification changes can be easily accommodated, and man-hours for design, production and installation can be greatly reduced.

A second embodiment of the present invention is described with reference to FIG. 13. The fundamental construction, including pressing units 5 and supporting beams 4, of the second embodiment is the same as that of the first embodiment, and the descriptions of such fundamentals is omitted.

Figure 13:
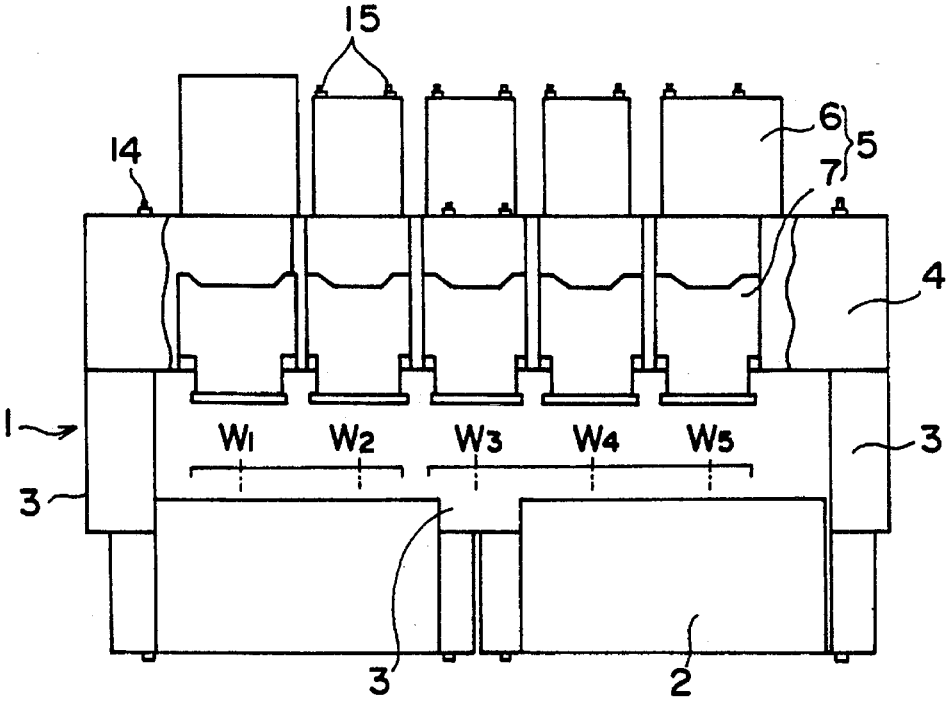
FIG. 13 is a front view of a transfer press according to a second embodiment of the present invention.

FIG. 13 shows, in a front view, a three-column transfer press having first to fifth workstations $W_1$, $W_2$, $W_3$, $W_4$ and $W_5$ for five pressing operations. In the illustrated example, a pair of elongated and box-shaped supporting beams 4, which are provided upon uprights 3 and disposed in a mutually spaced relationship on the front and back sides of a body 1, are divided by the middle uprights 3 at a substantially central location, into an upstream section containing workstations $W_1$ and $W_2$, and a downstream section containing workstations $W_3$, $W_4$, and $W_5$.

A pressing unit 5 located in correspondence with the first workstation $W_1$ (the most upstream workstation) comprises a link press unit having a slide-driving mechanism comprising a link mechanism. The second workstation $W_2$ et seq. are provided with pressing units 5 each comprising a crank press unit having a slide-driving mechanism comprising a crank mechanism.

In the body 1 of the press having the above construction, a workpiece fed from upstream of the body 1 is sequentially fed to the first through the fifth workstations $W_1$ to $W_5$ by a transfer feeder, not shown, whereby the workpiece is press formed at each of the workstations. Since the pressing units 5 at the individual workstations $W_1$, $W_2$, $W_3$, $W_4$ and $W_5$ are independent from each other, no idle stations have to be provided throughout the workstations $W_1$ to $W_5$. Although in the above-described example, the first workstation $W_1$ is provided with a pressing unit 5 whose crown 6 accommodates a slide-driving mechanism comprising a link mechanism, the first workstation $W_1$ can alternatively be provided with the same type of pressing unit as the other workstations, that is, a pressing unit 5 whose crown 6 accommodates a slide-driving mechanism comprising a crank mechanism.

With the second embodiment, it is possible to eliminate idling stations as uprights 3 do not have to be provided in correspondence with the individual workstations, thereby avoiding a required increase in the feed stroke of the transfer feeder. As a result, it is possible to improve producibility and lower transfer-feeder costs as well as to provide advantages of the elimination of idling, that is, to enable facilitated setup operation and the prevention of producibility reduction due to feeding errors.

What is claimed is:

1. In a transfer press having a plurality of workstations through which workpieces are sequentially fed in a first workpiece feed direction from workstation to workstation for accomplishing a plurality of pressing operations, the improvement comprising the combination of:

a body having components comprising: a bed, uprights provided vertically upon said bed, a pair of supporting beams provided upon said uprights and disposed in spaced relationship with each other in a horizontal direction perpendicular to the direction in which a workpiece is fed, and a plurality of pressing units each of which is independently provided for a respective one of said plurality of pressing operations, said components being readily dividable from each other;

a plurality of crowns;

a plurality of slides;

each of said plurality of pressing units including a respective one of said plurality of crowns, which is removably mounted upon said supporting beams, and a respective one of said plurality of slides, which is positioned for movement with respect to the associated crown.

2. A transfer press according to claim 1, wherein each of said crowns accommodates a slide-driving mechanism for being driven by a clutch and being braked by a brake, whereby the associated slide is driven by the respective slide-driving mechanism.

3. A transfer press according to claim 1, further comprising slide guide means provided on said supporting beams for guiding the movement of each of the slides.

4. A transfer press according to claim 3, wherein said slide guide means comprises a plurality of slide guides provided on the inner sides of said supporting beams for guiding the vertical motion of said slides.

5. In a transfer press having a plurality of workstations through which workpieces are sequentially fed in a first direction from workstation to workstation for accomplishing a plurality of pressing operations, the improvement comprising the combination of:

a body which is readily separated, for purposes of transportation of the body in a disassembled condition, into a bed, a plurality of uprights, a pair of supporting beams, and a plurality of pressing units;

said plurality of uprights extending upwardly from said bed, when said body is assembled, to support said pair of supporting beams so that said supporting beams extend generally parallel to said first direction with said pair of beams being spaced apart from each other in a horizontal direction perpendicular to said first direction;

each of said plurality of pressing units including a crown and a slide which is movable vertically relative to the associated crown, each of said crowns being removably mounted to and suspended from said pair of supporting beams, when said body is assembled, so as to position the respective slide at a respective one of the workstations.

6. A transfer press in accordance with claim 5, further comprising a plurality of slide guides for guiding the vertical movement of each of the slides.

7. A transfer press in accordance with claim 6, wherein each of said crowns contains a slide-driving mechanism for controlling the vertical movement of the associated slide.

8. A transfer press in accordance with claim 7, further comprising a motor for driving the slide-driving mechanisms, and a brake for braking the slide-driving mechanisms.

9. A transfer press in accordance with claim 8, wherein each of the slides is guided by a plurality of the slide guides, the slide guides being mounted on said supporting beams exteriorly of the associated slide.

10. A transfer press in accordance with claim 8, wherein each of said slide-driving mechanisms comprises a crank mechanism.

11. A transfer press in accordance with claim 10, wherein the uprights are positioned on said bed as a first set thereof supporting one of said pair of supporting beams and a second set thereof supporting the other of said pair of supporting beams, with the number of uprights in each of said first and second sets being less than the number of pressing units.

12. A transfer press in accordance with claim 11, which is free of idle stations.

13. A transfer press in accordance with claim 12, wherein each of said supporting beams comprises an elongated, box-shaped beam which extends in said first direction over at least substantially the full length of said body.

14. A transfer press in accordance with claim 13, wherein each of said slide-driving mechanisms comprises a flywheel having a built-in clutch, said flywheel being driven by said motor and driving a drive pinion, a pair of drive shafts, each of said drive shafts having a drive gear and a main pinion mounted thereon for rotation therewith, an idle gear, said drive pinion driving the drive gear on one of said pair of drive shafts by direct engagement therewith and driving the drive gear on the other of said pair of drive shafts through said idle gear, a pair of main gears, each of said main gears having an eccentric element mounted for rotation therewith, each of said main gears being driven by a respective one of the main pinions, each of the eccentric elements being connected through a plunger to the respective slide.

15. A transfer press in accordance with claim 5, wherein each of said crowns contains a slide-driving mechanism for controlling the vertical movement of the associated slide.

16. A transfer press in accordance with claim 13, further comprising a motor for driving the slide-driving mechanisms, and a brake for braking the slide-driving mechanisms.

17. A transfer press in accordance with claim 5, wherein the vertical motion of each of the slides is guided by a plurality of slide guides, the slide guides being mounted on said supporting beams exteriorly of the associated slide.

18. A transfer press in accordance with claim 15, wherein each of said slide-driving mechanisms comprises a crank mechanism.

19. A transfer press in accordance with claim 5, which is free of idle stations.

20. A transfer press in accordance with claim 5, wherein each of said supporting beams comprises an elongated, box-shaped beam which extends in said first direction over at least substantially the full length of said body.

21. A transfer press having a plurality of workstations through which workpieces are sequentially fed in a first direction from workstation to workstation for accomplishing a plurality of pressing operations, said transfer press comprising:

a body which is readily separated, for purposes of transportation of the body in a disassembled condition, into a bed, a plurality of uprights, a pair of supporting beams, and a plurality of pressing units;

said plurality of uprights extending upwardly from said bed, when said body is assembled, to support said pair of supporting beams so that said supporting beams extend generally parallel to said first direction with said pair of beams being spaced apart from each other in a horizontal direction perpendicular to said first direction;

each of said plurality of pressing units including a crown and a slide which is movable vertically relative to the associated crown, each of said crowns being removably mounted to and suspended from said pair of supporting beams, when said body is assembled, so as to position the respective slide at a respective one of the workstations;

wherein the uprights are positioned on said bed as a first set thereof supporting one of said pair of supporting beams and a second set thereof supporting the other of said pair of supporting beams, with the number of uprights in each of said first and second sets being less than the number of pressing units.

* * * * *